US007249836B2

(12) United States Patent
Yokoyama

(10) Patent No.: US 7,249,836 B2
(45) Date of Patent: Jul. 31, 2007

(54) INK JET PRINTER

(75) Inventor: Takeshi Yokoyama, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 282 days.

(21) Appl. No.: 10/731,278

(22) Filed: Dec. 9, 2003

(65) Prior Publication Data

US 2004/0114016 A1 Jun. 17, 2004

(30) Foreign Application Priority Data

Dec. 12, 2002 (JP) ..... 2002-360933

(51) Int. Cl.
*B41J 2/01* (2006.01)

(52) U.S. Cl. ..... 347/102; 347/103

(58) Field of Classification Search ..... 347/102, 347/103

See application file for complete search history.

(56) References Cited

U.S. PATENT DOCUMENTS 4,978,969 A * 12/1990 Chieng ..... 347/102
4,991,506 A 2/1991 Rodi
5,666,140 A * 9/1997 Mitani et al. ..... 347/12
6,037,961 A 3/2000 Saito et al.
6,078,713 A 6/2000 Tausch et al.
6,248,804 B1 6/2001 Lutz
6,561,640 B1 * 5/2003 Young ..... 347/102
6,626,517 B2 * 9/2003 Iwasaki et al. ..... 347/40

FOREIGN PATENT DOCUMENTS

WO WO-01/11426 A1 2/2001

OTHER PUBLICATIONS

European Search Report for Application No. 03257728.0-2304 dated Dec. 22, 2004.

* cited by examiner

*Primary Examiner*—Stephen Meier
*Assistant Examiner*—Ly T. Tran
(74) *Attorney, Agent, or Firm*—Cantor Colburn LLP

(57) ABSTRACT

An ink jet printer has a recording head, having a nozzle, for jetting ink to be cured by irradiating with an ultraviolet ray from the nozzle, and an ultraviolet ray irradiating device for irradiating the ink jetted by the recording head with a plurality of ultraviolet rays. The ultraviolet ray irradiating device has a plurality of ultraviolet ray sources respectively emitting a plurality of ultraviolet rays of a plurality of light emitting wavelength peaks different from one another. After the ink jetted from the nozzle arrives at a recording medium, an image is formed by irradiating the ink of the recording medium with the ultraviolet rays of the ultraviolet ray irradiating device and curing the ink.

9 Claims, 7 Drawing Sheets

INK JET PRINTER

BACKGROUND OF THE INVENTION

1. Field of the Invention

The present invention relates to an ink jet printer, and particularly to an ink jet printer for forming an image by irradiating ink with ultraviolet rays to cure the ink.

2. Description of Related Art

An ink jet printer having a plurality of recording heads and a plurality of ultraviolet ray irradiating devices has been recently used. Each recording head is provided with a plurality of nozzles for jetting ink to be cured by irradiating with ultraviolet rays, and each ultraviolet ray irradiating device irradiates the ink with ultraviolet rays to cure the ink (For example, refer to Published Japanese Patent Publication (Tokkaisyo) S60-132767).

As an ultraviolet ray source for irradiating a recording medium with ultraviolet rays, a high pressure mercury lamp, a metal halide lamp, a hot cathode tube, a cold cathode tube, a light emitting diode (LED), a laser diode or the like is used in the earlier development. In case of the hot cathode tube, the cold cathode tube, the light emitting diode (LED), the laser diode and the like, the ultraviolet ray has a single wavelength at an emitted light wavelength peak. In an earlier developed ink jet printer, for example, a plurality of rod-shaped cold cathode tubes are arranged in the ultraviolet ray irradiating device to emit ultraviolet rays having a single wavelength at an emitted light wavelength peak.

Further, to form an image on a recording medium which is made of a material not absorbing ink such as a film made of resin, metal or the like, an ink composition (for example, refer to Published Japanese Patent Publication (Tokkaihei) H3-216379) including a component to be polymerized by irradiating with ultraviolet rays and an ink composition (for example, refer to Published Japanese Patent Publication (Tokkaihei) H3-216379) including a color material, an ultraviolet ray curing agent, a photochemical polymerization initiator and the like have been proposed (for example, refer to the specification of U.S. Pat. No. 5,623,001).

For example, the color material dissolving or dispersing in a main component of a polymerizing compound is used for an ultraviolet ray curable ink. In view of the weather-resist property of the color material, pigment is preferable as the color material.

However, in the earlier developed ink jet printer using the high pressure mercury lamps or the metal halide lamps as the ultraviolet ray sources, the size of the high pressure mercury lamp or the metal halide lamp is not so small. Therefore, a problem is arisen that the ink jet printer is manufactured in a large scale. Further, because a carriage holding the ultraviolet ray irradiating devices becomes heavy, another problem is arisen that a moving speed of the carriage is decelerated and an image forming efficiency deteriorates.

On the other hand, in the earlier developed ink jet printer using the hot cathode tubes, the cold cathode tubes, the LEDs, the laser diodes or the like as the ultraviolet ray sources, ultraviolet rays having only a single peak wavelength are emitted. However, because sensitivity of the ultraviolet ray curable ink to the ultraviolet rays of a wavelength depends on the type of the pigment used as the color material of the ink, the wavelength of the ultraviolet rays appropriate to the easily curing of the ultraviolet ray curable ink depends on the type of the pigment. Accordingly, in the earlier developed ink jet printer, when the ink has not sufficiently high sensitivity to the ultraviolet rays having a wavelength at a single light emitting wavelength peak, it is difficult to cure the ink, and a problem is arisen that the image quality of the formed image deteriorates.

SUMMARY OF THE INVENTION

In order to solve the above problem, an object of the present invention is to provide an ink jet printer, which has an excellent image forming efficiency in a small size and forms an excellent image regardless of a type of ink.

In order to accomplish the above-mentioned object, in accordance with the first aspect of the present invention, an ink jet printer comprises:

a recording head, having a nozzle, for jetting ink to be cured by irradiating with an ultraviolet ray from the nozzle, the ink jetted from the nozzle arriving at a recording medium; and an ultraviolet ray irradiating device for irradiating the ink jetted by the recording head with a plurality of ultraviolet rays, an image being formed by irradiating the ink of the recording medium with the ultraviolet rays of the ultraviolet ray irradiating device and curing the ink, wherein the ultraviolet ray irradiating device comprises a plurality of ultraviolet ray sources respectively emitting a plurality of ultraviolet rays of a plurality of light emitting wavelength peaks different from one another.

In the ink jet printer according to the first aspect of the present invention, because the ultraviolet ray sources of the different light emitting wavelength peaks are arranged in the ink jet printer, the ink arriving at the recording medium is irradiated with the ultraviolet rays of a plurality of wavelengths. Therefore, each of various types ink respectively having the sensitivity to the ultraviolet rays of the different wavelengths can be irradiated with the ultraviolet ray of the wavelength optimum to the curing of the ink.

Accordingly, even though various types of ink have the sensitivity to the ultraviolet rays of the different wavelengths, each type of ink is irradiated with the ultraviolet ray of the wavelength optimum to the curing of the ink, and the ink can be satisfactorily cured. Accordingly, the excellent image can be formed regardless of the type of the ink.

Preferably, the ultraviolet ray sources emitting the ultraviolet rays of the different light emitting wavelength peaks are arranged in the single ultraviolet ray irradiating device.

In this ink jet printer, because the ultraviolet ray sources of the different light emitting wavelength peaks are arranged in the single ultraviolet ray irradiating device, even though only the single ultraviolet ray irradiating device is arranged in the ink jet printer, the ink arriving at the recording medium can be irradiated with a plurality of ultraviolet rays of a plurality of wavelengths.

Accordingly, even though only the single ultraviolet ray irradiating device is arranged in the ink jet printer, an excellent image can be formed regardless of the type of the ink.

Preferably, the ultraviolet ray irradiating device comprises a plurality of ultraviolet ray irradiating devices, and the ultraviolet ray sources emitting the ultraviolet rays of the different light emitting wavelength peaks are arranged in each of the ultraviolet ray irradiating devices.

In this ink jet printer, because the ultraviolet ray sources emit the ultraviolet rays of the different wavelengths respectively, the ink arriving at the recording medium can be irradiated with the ultraviolet rays of the plurality of wavelengths.

Accordingly, an excellent image can be formed regardless of the type of the ink.

Preferably, at least one ultraviolet ray source of the ultraviolet ray having a shorter wavelength component at the light emitting wavelength peak is arranged at a position adjacent to and closer to the recording head than that of the other ultraviolet ray source.

In this ink jet printer, because at least one ultraviolet ray source of the ultraviolet ray having the shorter wavelength component at the light emitting wavelength peak is arranged at the position adjacent to and closer to the recording head than that of the other ultraviolet ray source, the ink jetted from the recording head to the recording medium is first irradiated with the ultraviolet ray having the shorter wavelength.

Accordingly, even though the ink has high sensitivity to the ultraviolet ray of a longer wavelength, because the surface of the ink is cured in a short time after the arriving of the ink at the recording medium, the blurring and/or color mixing of the ink on the recording medium can be further prevented.

Preferably, the light emitting wavelength peaks of the ultraviolet ray sources range from 220 nm to 400 nm.

In this ink jet printer, because the light emitting wavelength peaks of the ultraviolet ray sources range from 220 nm to 400 nm, the ink is satisfactorily cured.

Accordingly, the excellent image can be formed

Preferably, each ultraviolet ray source is a hot cathode tube, a cold cathode tube, a light emitting diode or a semiconductor laser.

In this ink jet printer, a plurality of small-sized ultraviolet ray sources irradiate the ink arriving at the recording medium with the ultraviolet rays of the plurality of wavelengths respectively.

Accordingly, the ultraviolet ray sources can be miniaturized, and the ink jet printer can be miniaturized. In a serial head type ink jet printer, the moving speed of a carriage is not decelerated, and the image forming efficiency can be heightened.

Preferably, the ultraviolet ray irradiating device is arranged only on a side of a recording surface of the recording medium.

Preferably, the ink is a cationic curable ink.

In this ink jet printer, because the ink is the cationic curable ink, the ink can be cured by the irradiation with ultraviolet rays having comparatively low illuminance.

Accordingly, the consumed electric power can be lowered.

Preferably, the recording head is of a serial head type, and the ultraviolet ray irradiating device is arranged at least on one of both sides of the recording head in a main scanning direction.

In this ink jet printer, the ultraviolet ray irradiating device is arranged at least on one of both sides of the recording head in a direction of the reciprocal movement of the recording head. Therefore, the ink jetted from the nozzles of the recording head and arriving at the recording medium is irradiated with the ultraviolet rays of the plurality of wavelengths by reciprocally moving the recording head and the ultraviolet ray irradiating device.

Accordingly, an excellent image can be formed regardless of the type of the ink.

Preferably, the recording head is of a line head type, and the ultraviolet ray irradiating device is arranged on a downstream side of the recording head in a feeding direction of the recording medium.

In this ink jet printer, the ultraviolet ray irradiating device is arranged on a downstream side of the line head type recording head in the feeding direction of the recording medium. Therefore, the ink jetted from the nozzles of the recording head and arriving at the recording medium is irradiated with the ultraviolet rays of the plurality of wavelengths by moving the recording medium.

Accordingly, an excellent image can be formed regardless of the type of the ink.

BRIEF DESCRIPTION OF THE DRAWINGS

The present invention will become more fully understood from the detailed description given hereinbelow and the accompanying drawing which are given by way of illustration only, and thus are not intended as a definition of the limits of the present invention, and wherein.

PREFERRED EMBODIMENTS OF THE INVENTION

Hereinafter, the embodiments of the present invention will be explained with reference to FIGS. 1 to 7.

First Embodiment

Figure 1:
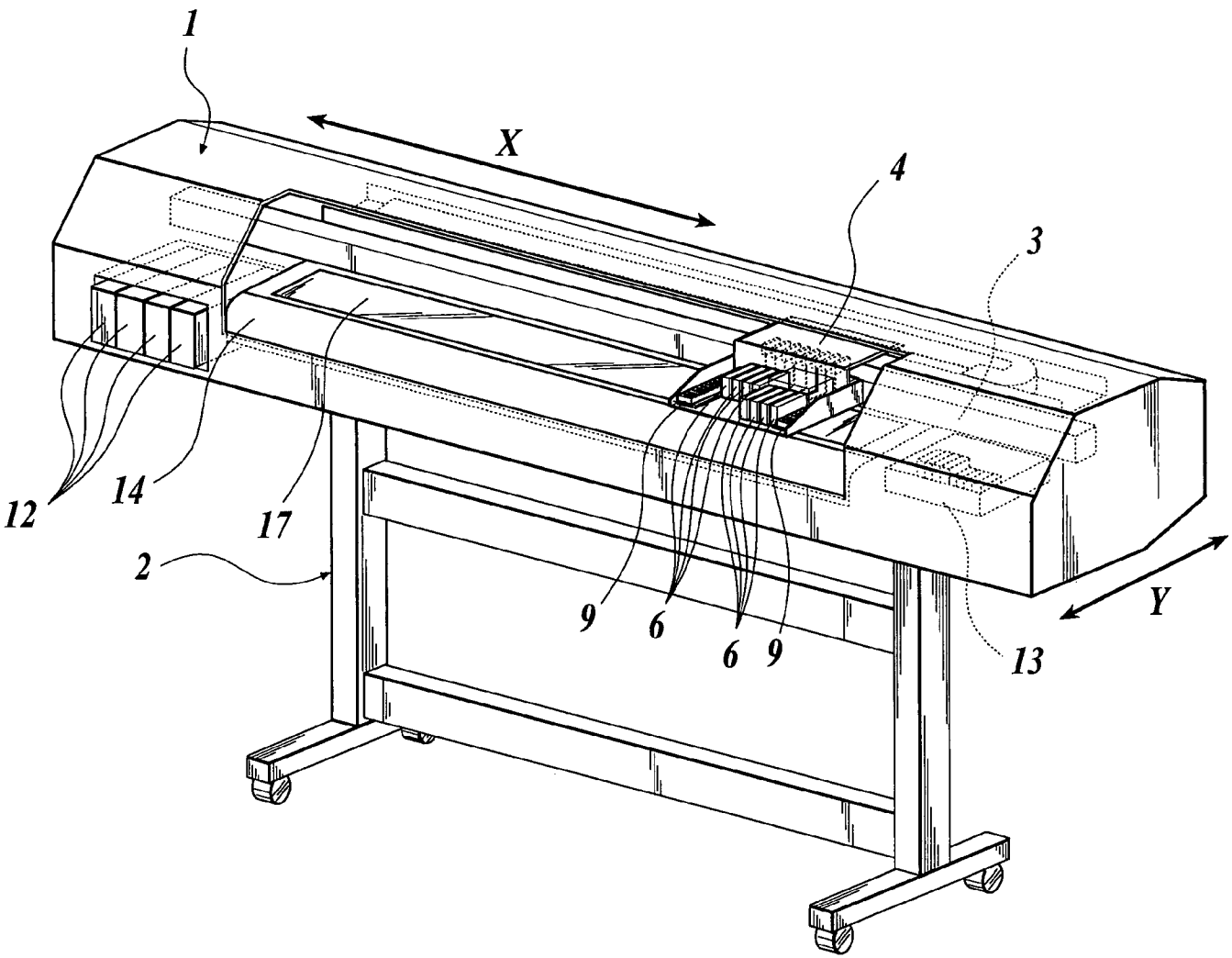
FIG. 1 is a view showing an ink jet printer according to the first embodiment of the present invention.

As shown in FIG. 1, an ink jet printer of the first embodiment comprises a printer body 1 and a supporting stand 2 for supporting the printer body 1. The printer body 1 comprises a guide rail 3 formed in a rod shape, and a carriage 4 is supported by the guide rail 3. The carriage 4 reciprocally moves along the guide rail 3 in a main scanning direction X by operating a driving mechanism (not shown).

Figure 2A:
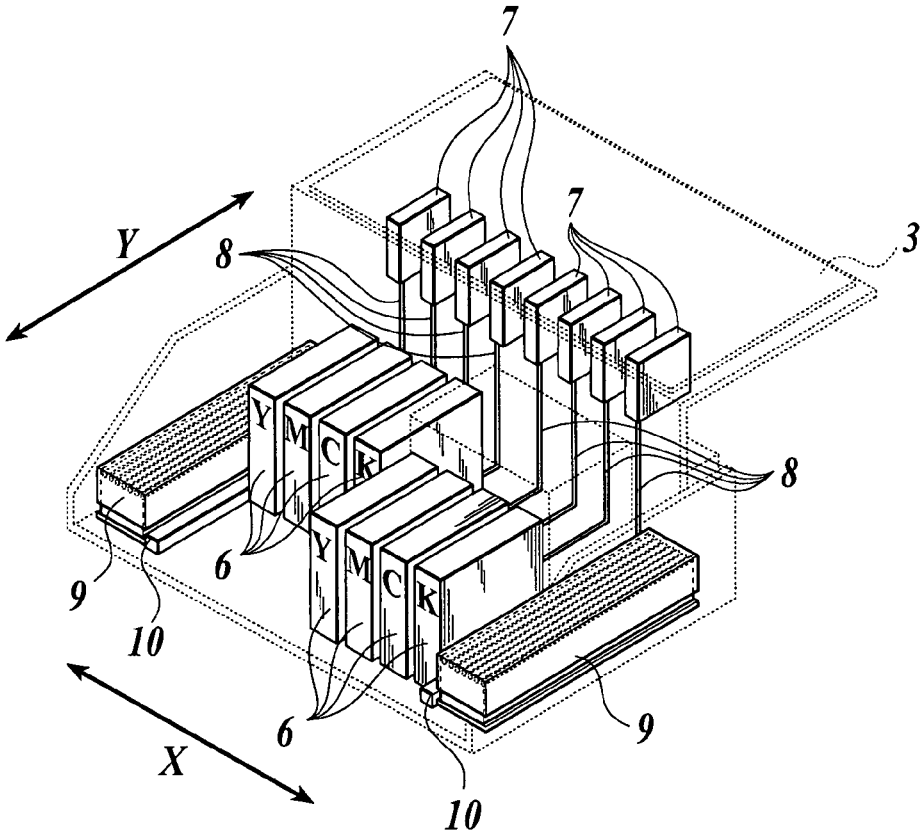
FIG. 2A is a perspective side view showing a carriage of the ink jet printer of the present invention.
Figure 2B:
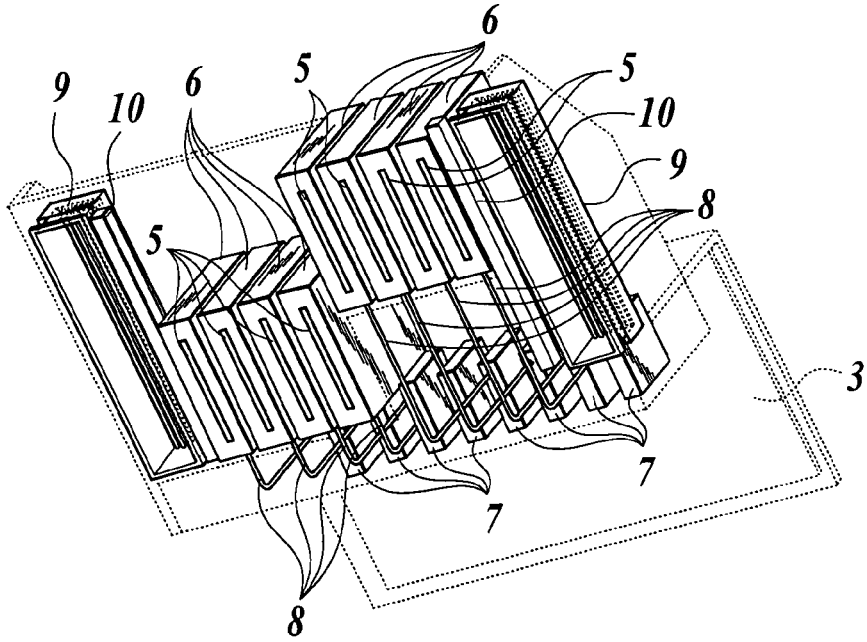
FIG. 2B is a perspective side view showing the carriage seen from the lower side.

As shown in FIG. 2, a plurality of recording heads 6 corresponding to colors of yellow (Y), magenta (M), cyan (C) and black (K) respectively are arranged in the carriage 4, and each recording head 6 has a plurality of nozzles 5 for jetting the ink corresponding to the color of yellow (Y), magenta (M), cyan (C) or black (K). Each of two recording units is composed of the four recording heads 6 corresponding to the colors of yellow (Y), magenta (M), cyan (C) and black (K) respectively. The two recording units are arranged along the main scanning direction X while shifting in a sub-scanning direction Y. Each of a plurality of intermediate tanks 7 holding the types of ink corresponding to the four colors respectively is connected to the corresponding recording head 6 through an ink supply tube 8.

In the carriage 4, two ultraviolet ray irradiating devices 9 irradiating a recording medium 17 having the ink jetted from the nozzles 5 with ultraviolet rays are respectively arranged at both ends of the recording heads 6 in the main scanning direction X. In this embodiment, the ultraviolet ray irradiating devices 9 are arranged only on the side of a recording surface of the recording medium 17, and no ultraviolet ray irradiating device 9 is arranged on the side of a non-recording surface of the recording medium 17.

A light trap 10 is arranged between the group of recording heads 6 and each ultraviolet ray irradiating device 9 to trap the ultraviolet rays incident on the end areas of the recording heads 6. Each light trap 10 is a box-shaped member opened toward the side of the recording medium 17 and repeatedly reflects the ultraviolet rays incident on the trap 10 on the inner surface thereof to trap the ultraviolet rays.

As shown in FIG. 1, the middle of a movable range of the carriage 4 is set as a recording region in which an image is recorded on the recording medium 17. Four ink supply units 12 supplying the types of ink corresponding to the four colors to the intermediate tanks 7 arranged in the carriage 4 through ink supply paths (not shown) respectively are arranged at one end of the outside of the recording region within the movable range of the carriage 4. A maintenance unit 13 is arranged at the other end of the outside of the recording region within the movable range of the carriage 4 to clean out the recording heads 6.

A feeding mechanism (not shown) is arranged in the printer body 1 to feed the recording medium 17 in the sub-scanning direction Y perpendicular to the main scanning direction X. The feeding mechanism is, for example, provided with a feeding motor, feeding rollers and the like (not shown) and feeds the recording medium 17 in the sub-scanning direction Y while rotating the feeding rollers by the driving of the feeding motor. Further the feeding mechanism intermittently feeds the recording medium 17 in the image recording operation while repeatedly performing the feeding and stopping of the recording medium 17 in synchronization with the movement of the carriage 4.

A platen 14 supporting a non-recording surface of the recording medium 17 is arranged in the recording region placed at a lower position of the carriage 4. The platen 14 is made of a member formed in a plane plate shape.

Figure 3A:
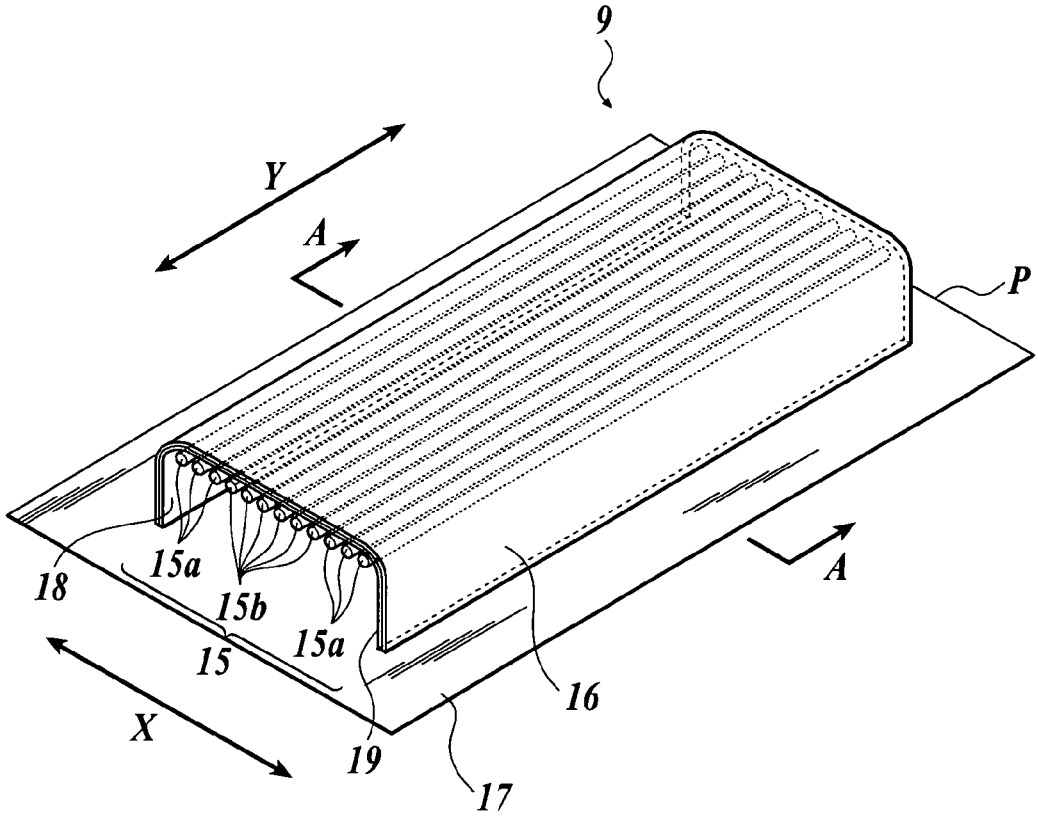
FIG. 3A is a perspective side view showing an ultraviolet ray irradiating device of the ink jet printer of the present invention.
Figure 3B:
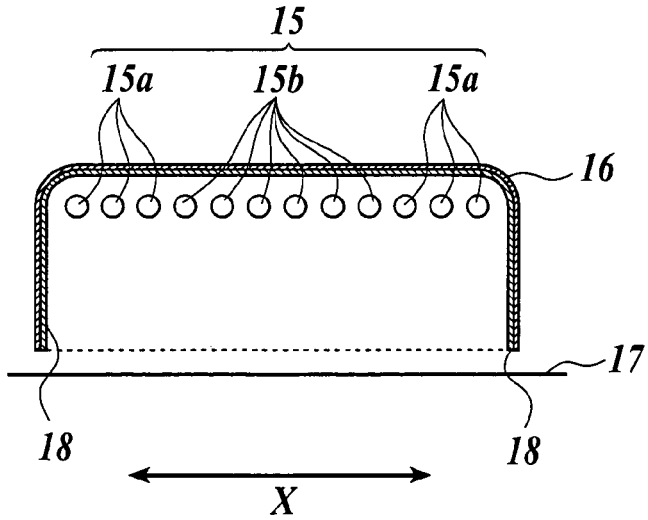
FIG. 3B is a cross sectional view taken substantially along line A-A of FIG. 3A.
Figure 4A:
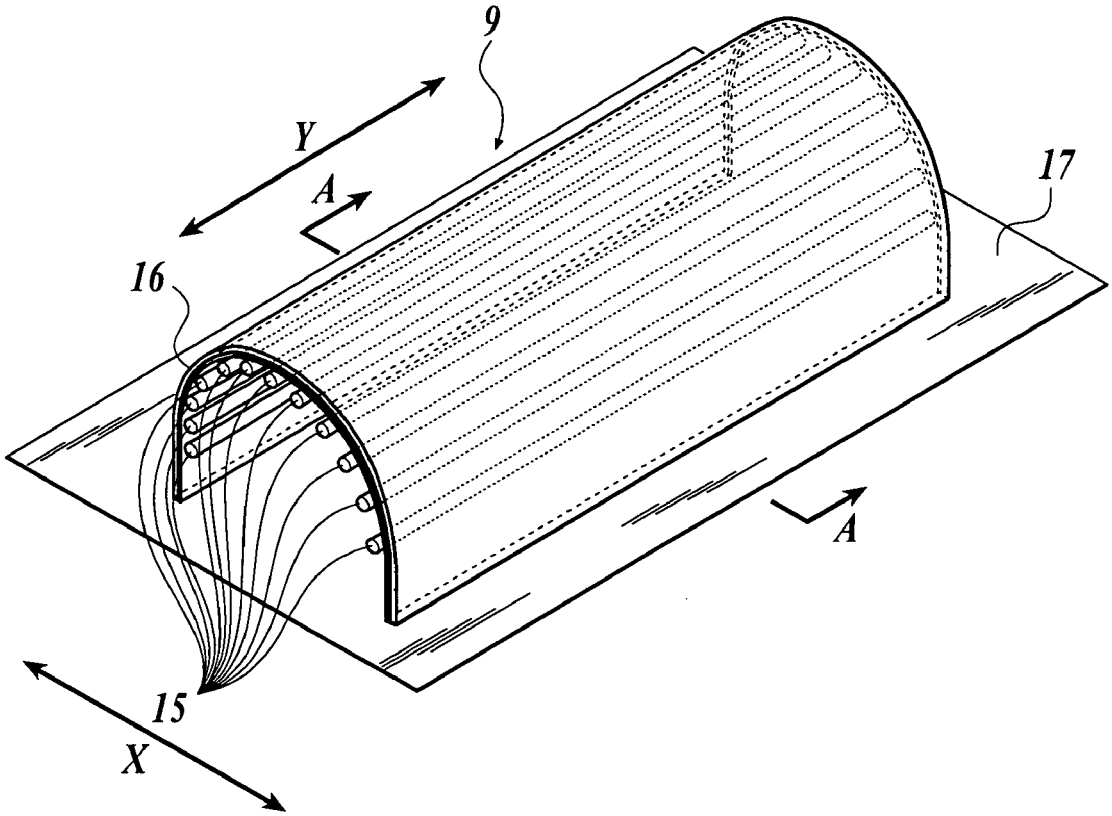
FIG. 4A is a perspective side view showing an ultraviolet ray irradiating device of the ink jet printer of the present invention.
Figure 4B:
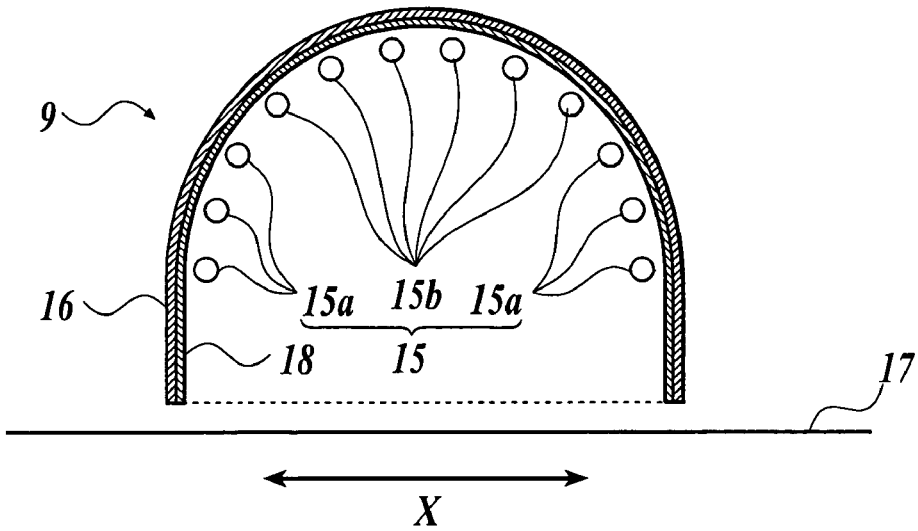
FIG. 4B is a cross sectional view taken substantially along line A-A of FIG. 4A.

Next, the ultraviolet ray irradiating device 9 will be described in detail with reference to FIG. 3.

The ultraviolet ray irradiating device 9 has a box-shaped cover member 16 opened toward the side of the recording medium 17, and a reflecting member 18 reflecting ultraviolet rays emitted and dispersing from a plurality of ultraviolet ray sources 15 is arranged on the entire inner surface of the cover member 16. For example, a reflecting plate made of aluminum at high purity is applied as the reflecting member 18 because the reflecting plate efficiently reflects the ultraviolet rays in a band of all wavelengths of the ultraviolet rays. Particularly, a cold mirror (glass-formed plate) obtained by depositing a thin film of a metallic compound mainly including aluminum on the surface of glass efficiently reflects the ultraviolet rays and transmits visible rays and infrared rays, not contributing to the curing of the ink, to the back side of the cold mirror. Therefore, the cold mirror can suppress the lowering of a light emitting efficiency of the ultraviolet ray sources 15 caused by the heating-up of the sources 15, and the cold mirror is preferably applied to the reflecting member 18.

A plurality of rod-shaped ultraviolet ray sources 15*a* having a wavelength at an emitted light wavelength peak and a plurality of rod-shaped ultraviolet ray sources 15*b* having a wavelength different from that of the sources 15*a* at an emitted light wavelength peak are arranged in the inside of the cover member 16 so as to be adjacent to one another in the main scanning direction X. The length of each ultraviolet ray source 15 is almost equal to a combined length of the two recording units in the sub-scanning direction Y.

The ultraviolet ray sources 15*a* having a shorter wavelength component at the emitted light wavelength peak are arranged at both ends of the series of ultraviolet ray sources 15 in the main scanning direction X, and the ultraviolet ray sources 15*b* having a longer wavelength component at the emitted light wavelength peak are arranged in the middle of the series of ultraviolet ray sources 15 in the main scanning direction X.

At least one of the hot cathode tube, the cold cathode tube, LED and a semiconductor laser is applied as each ultraviolet ray source 15.

Next, the ink used in this embodiment will be described.

Ink conforming to conditions described in "Curing System Using Optical Acid Radical-Base Generating Agent (first section)" or "Light-Induced Alternate Copolymer (second section)" of "Photo-Curing System (fourth chapter)" of "Photo-Curing Technique—Selection and Mixing Condition of Resin and Initiator Agent and Measurement and Estimation of Curing—(Information of Technical Association)" or the like can be particularly applied as the ink used in this embodiment, and ink to be cured by the normal radical polymerization may be used.

In detail, the ink used in this embodiment is photo-curable ink having a property cured by the irradiation with ultraviolet rays representing light and includes at least a polymerizing compound (including the known polymerizing compound), a photochemical initiator and a color material as main components. However, when the ink conforming to conditions described in "Light-Induced Alternate Copolymer (second section)" is used as the ink used in this embodiment, the photochemical initiator may be omitted.

The photo-curable ink is classified into a radical polymerization type ink including a radical polymerizing compound and cationic polymerization type ink including a cationic polymerizing compound. Both types ink can be applied as the ink used in this embodiment, and a hybrid type ink obtained by the combination of the radical polymerization type ink and the cationic polymerization type ink may be applied as the ink used in this embodiment.

However, because the cationic polymerization type ink hardly or not damaged by the polymerization based on oxygen is excellent functionally and widely in use, the cationic polymerization type ink is used in this embodiment.

The cationic polymerization type ink used in this embodiment is the mixture including at least a cationic polymerizing compound such as an oxetane compound, an epoxy compound, a vinyl ether compound or the like, a photochemical cationic initiator and a color material, and the type of ink has a property of the curing by the irradiation with the ultraviolet rays.

The photochemical initiator included in the ink has the sensitivity to the ultraviolet rays of the shorter wavelength. However, the pigment included in the ink has a property of absorbing shorter wavelength components of the ultraviolet rays, and the shorter wavelength components of the ultraviolet rays are easily scattered by particles of the pigment. Therefore, a sensitizer is mixed with the ink to make the ink have the sensitivity to the ultraviolet rays of the longer wavelength. Further, because the degree of the absorbing and scattering property of the pigment to the shorter wavelength components of the ultraviolet rays changes in dependence on the type of the pigment, the wavelength, to which the ink has the sensitivity, changes in dependence on the type of the pigment.

The degree of the curing of the ink is shown in Table 1 and Table 2 on condition that the ink of each color is irradiated with the ultraviolet rays having the single wavelength peak and emitted from a plurality of ultraviolet ray sources for a predetermined time. In the estimation of the degree of the curing of the ink, when the curing of the ink and no scratch generated on the ink surface are found out as a result of the finger's touching to the ink performed just after the irradiation with the ultraviolet rays, the degree of the curing of the ink is expressed by the symbol ○. When scratches are easily generated on the ink surface as a result of the finger's touching to the ink, the degree of the curing of the ink is expressed by the symbol Δ. When no curing of the ink is found out as a result of the finger's touching to the ink performed just after the irradiation with the ultraviolet rays, the degree of the curing of the ink is expressed by the symbol X.

The table 1 shows on condition that eight ultraviolet ray fluorescent lamps emitting the ultraviolet rays of the peak wavelength of 254 nm are used. The table 2 shows on condition that eight ultraviolet ray fluorescent lamps emitting the ultraviolet rays of the peak wavelength of 315 nm are used. The ultraviolet ray fluorescent lamps manufactured by the High Beck company are used as the ultraviolet ray sources.

TABLE 1

| | Irradiation time (second) | | |
|---|---|---|---|
| Types of ink | 1.7 | 1.3 | 0.8 |
| Yellow (Y) | Δ | X | X |
| Magenta (M) | ○ | Δ | X |
| Cyan (C) | ○ | ○ | ○ |
| Black (K) | ○ | ○ | Δ |

TABLE 2

| | Irradiation time (second) | | |
|---|---|---|---|
| Types of ink | 1.7 | 1.3 | 0.8 |
| Yellow (Y) | ○ | ○ | ○ |
| Magenta (M) | ○ | ○ | ○ |
| Cyan (C) | ○ | ○ | Δ |
| Black (K) | ○ | ○ | Δ |

In Table 1 and Table 2, because the yellow (Y) ink and the magenta (M) ink have a low sensitivity to the ultraviolet rays of the shorter wavelength, the types of ink are difficult to be cured by the irradiation with the ultraviolet rays of the shorter wavelength. Because the cyan (C) ink has a slightly low sensitivity to the ultraviolet rays of the longer wavelength, the cyan (C) ink is difficult to be cured in a short time by the irradiation with the ultraviolet rays of the longer wavelength.

Next, the degree of the curing of the ink is shown in Table 3 and Table 4 on condition that a plurality of types of ultraviolet ray sources emitting respectively ultraviolet rays of emitted light wavelength peaks different from each other are combined with one another to irradiate the ink of each color with the ultraviolet rays emitted from the combined ultraviolet ray sources for a predetermined time. The table 3 shows on condition that two ultraviolet ray fluorescent lamps emitting the ultraviolet rays of the peak wavelength of 254 nm and six ultraviolet ray fluorescent lamps emitting the ultraviolet rays of the peak wavelength of 315 nm are used. The table 4 shows on condition that four ultraviolet ray fluorescent lamps emitting the ultraviolet rays of the peak wavelength of 254 nm and four ultraviolet ray fluorescent lamps emitting the ultraviolet rays of the peak wavelength of 315 nm are used.

TABLE 3

| | Irradiation time (second) | | |
|---|---|---|---|
| Types of ink | 1.7 | 1.3 | 0.8 |
| Yellow (Y) | ○ | Δ | X |
| Magenta (M) | ○ | ○ | Δ |
| Cyan (C) | ○ | ○ | ○ |
| Black (K) | ○ | ○ | ○ |

TABLE 4

| | Irradiation time (second) | | |
|---|---|---|---|
| Types of ink | 1.7 | 1.3 | 0.8 |
| Yellow (Y) | ○ | ○ | ○ |
| Magenta (M) | ○ | ○ | ○ |
| Cyan (C) | ○ | ○ | ○ |
| Black (K) | ○ | ○ | ○ |

In Table 3 and Table 4, when types of ultraviolet ray sources respectively emitting ultraviolet rays of emitted light wavelength peaks different from each other are combined with one another to irradiate the types of ink of the colors with the ultraviolet rays emitted from the combined ultraviolet ray sources, all color types of ink can be satisfactorily cured.

As described above, for example, it is preferable to arrange six ultraviolet ray sources emitting ultraviolet rays of the peak wavelength of 254 nm and six ultraviolet ray sources emitting ultraviolet rays of the peak wavelength of 313 nm in the inside of the cover member 16. In this case, the ultraviolet ray sources emitting ultraviolet rays of the shorter peak wavelength of 254 nm (corresponding to the ultraviolet ray sources 15*a* in FIG. 3B) are arranged at both ends of the series of ultraviolet ray sources in the main scanning direction X, and the ultraviolet ray sources emitting ultraviolet rays of the peak wavelength of 313 nm (corresponding to the ultraviolet ray sources 15*b* in FIG. 3B) are arranged in the middle of the series of ultraviolet ray sources in the main scanning direction X.

Next, the recording medium 17 used in this embodiment will be described.

As the recording medium 17 used in this embodiment, various types papers applied to the normal ink jet printer such as a plain paper, a recycled paper, a glossy paper and the like, and record media made of materials such as various types clothes, various types non-woven fabrics, resin, metal, glass and the like can be applied. Further the record media formed in a roll shape, a cut sheet shape, a plate shape and the like can be applied to the recording medium 17. In this embodiment, a lengthened resin film made of resin and rolled in a roll shape is used as the recording medium 17.

Particularly, a film, which is made of resin, has the transparent or opaque and non-absorptive property and is used for so-called flexible packaging, can be applied as the recording medium 17 used in this embodiment. As types of resin used for the film, polyethylene-terephthalate, polyester, polyolefin, polyamide, polyesteramide, polyether, polyimide, polyamideimide, polystyrene, polycarbonate, poly-p-phenylenesulfide, polyetherester, polyvinyl chloride, poly (meta)acrylicester, polyethylene, polypropylene, nylon and the like can be applied. Further, co-polymer of those types of resin, mixture of those types of resin, bridge formation of those types of resin and the like can be applied as the resin used for the film. Among of those types of resin, when transparency, size stability, stiffness, environmental burden, cost and the like in the film made of resin are considered, any of the extended polyethyleneterephthalate, polystyrene, polypropylene and nylon is preferred as the type of resin used for the film. Further the film made of resin and having the thickness of 2 micro-meters (μm) or more and 100 μm or less (preferably, 6 μm or more and 50μm or less) is preferred. Further surface treatment such as corona jet treatment, adhesion-adding treatment or the like may be performed for the surface of a supporting member of the film made of resin.

Moreover, known opaque record media such as various papers of which the surfaces are coated with resin, a film including pigment, a foam film and the like can be applied as the recording medium 17 used in this embodiment.

Next, the operation of the ink jet printer according to this embodiment will be described.

When the image is formed on the recording medium 17, the driving mechanism of the carriage 4 is operated to reciprocally move the carriage 4 in the main scanning direction X above the recording medium 17, and ink of a prescribed color is jetted from the nozzles 5 of each recording head 6 arranged in the carriage 4 according to predetermined image information. A plurality of drops of jetted ink arrive at the recording medium 17 one after another. The ultraviolet ray sources 15 composing each ultraviolet ray irradiating device 9 arranged in the carriage 4 irradiate the pieces of ink arriving at the recording medium 17 with the ultraviolet rays, and the ink is cured on the recording medium 17. During the curing of the ink, the feeding mechanism is operated to feed the recording medium 17 in the sub-scanning direction Y, and the image is formed on the recording medium 17. When ink is attached to the surface of the nozzles 5, the recording head 6 of the nozzles 5 is cleaned out by the maintenance unit 13.

The curing of the ink performed by the irradiation with the ultraviolet rays will be described.

When the carriage 4 is reciprocally moved in the main scanning direction X, the ultraviolet ray sources 15*a* of the ultraviolet rays having the shorter wavelength component at the emitted light wavelength peak and the ultraviolet ray sources 15*b* of the ultraviolet rays having the longer wavelength component at the emitted light wavelength peak irradiate the pieces of ink arriving at the recording medium 17 with the ultraviolet rays. In this case, the pieces of ink having high sensitivity to the ultraviolet rays of the shorter wavelength are cured by the ultraviolet rays of the shorter wavelength emitted by the ultraviolet ray sources 15*a* of the ultraviolet rays having the shorter wavelength component at the emitted light wavelength peak, and the pieces of ink having high sensitivity to the ultraviolet rays of the longer wavelength are cured by the ultraviolet rays of the longer wavelength emitted by the ultraviolet ray sources 15*b* of the ultraviolet rays having the longer wavelength component at the emitted light wavelength peak.

Further, the ultraviolet ray sources 15*a* of the ultraviolet rays having the shorter wavelength at the emitted light wavelength peak are arranged at both ends of the series of ultraviolet ray sources 15 in the main scanning direction X, and the ultraviolet ray sources 15*b* of the ultraviolet rays having the longer wavelength at the emitted light wavelength peak are arranged in the middle of the series of ultraviolet ray sources 15 in the main scanning direction X. Therefore, regardless of whether the carriage 4 is moved in the going direction or the returning direction, the ink is first irradiated with the ultraviolet rays of the shorter wavelength, and then the ink is secondly irradiated with the ultraviolet rays of the longer wavelength. Because the photochemical initiator included in the ink has high sensitivity to the ultraviolet rays of the shorter wavelength, the ink including the pigment, which has the property of absorbing and scattering the ultraviolet rays of the shorter wavelength to a low degree, is cured by first irradiating the ink with the ultraviolet rays of the shorter wavelength. On the other hand, in case of the ink including the pigment which has the property of absorbing and scattering the ultraviolet rays of the shorter wavelength to a high degree, because the ultraviolet rays of the shorter wavelength are hardly transmitted to the inside of the ink, only the surface of the ink is cured by first irradiating the ink with the ultraviolet rays of the shorter wavelength, and then the inside of the ink is cured by the ultraviolet rays of the longer wavelength due to the function of the sensitizer which makes the ink have high sensitivity to the ultraviolet rays of the longer wavelength.

As described above, in this embodiment, the ultraviolet ray sources 15*a* and 15*b* emitting the ultraviolet rays of the emitted light wavelength peaks different from each other are arranged in each ultraviolet ray irradiating device 9, and the sources 15*a* and 15*b* irradiate the pieces of ink arriving at the recording medium 17 with the ultraviolet rays of a plurality of wavelengths. Therefore, even though the pieces of ink respectively have high sensitivity to the ultraviolet rays of the plurality of wavelengths, each piece of ink is irradiated with the ultraviolet rays of the wavelength optimum to the curing of the ink. Accordingly, because each piece of ink can be satisfactorily cured, the excellent image can be formed regardless of the type of the ink.

Further, the ultraviolet ray sources 15*a* of the ultraviolet rays having the shorter wavelength component at the emitted light wavelength peak are arranged at both ends of the series of ultraviolet ray sources 15 in the main scanning direction X, and the ultraviolet ray sources 15*b* of the ultraviolet rays having the longer wavelength component at the emitted light wavelength peak are arranged in the middle of the series of ultraviolet ray sources 15 in the main scanning direction X. Therefore, the ink is necessarily first irradiated with the ultraviolet rays of the shorter wavelength and is secondly irradiated with the ultraviolet rays of the longer wavelength. Because the ink fundamentally has high sensitivity to the ultraviolet rays of the shorter wavelength, the ink can be efficiently cured by first irradiating the ink with the ultraviolet rays of the shorter wavelength. Further, even though the ink has high sensitivity to the ultraviolet rays of the longer wavelength, the surface of the ink is cured in a short time after the arriving of the ink at the recording medium 17 by the ultraviolet rays of the shorter wavelength with which the ink are first irradiated. Accordingly, the blurring and/or color mixing of the ink on the recording medium 17 can be further prevented, and the excellent image can be formed regardless of the type of the ink.

In this embodiment, the ink jet printer is provided with the two recording units each of which comprises the four recording heads 6 corresponding to the colors of yellow (Y), magenta (M), cyan (C) and black (K), and the one ultraviolet ray irradiating device 9 is arranged for each recording unit. However, the present invention is not limited to this. The number and arrangement of recording heads 6 and the number and arrangement of ultraviolet ray irradiating devices 9 are optional on condition that the ultraviolet ray irradiating device 9 is arranged at least at one end of the group of the recording heads 6 in the main scanning direction X.

For example, four ultraviolet ray irradiating devices 9 and the four recording heads 6 corresponding to the four colors of yellow (Y), magenta (M), cyan (C) and black (K) may be alternately arranged so as to place each ultraviolet ray irradiating device 9 between two recording heads 6 adjacent to each other. In this case, a plurality of ultraviolet ray sources 15 emitting ultraviolet rays of a wavelength, to which the colored ink jetted from each recording head 6 appropriately has high sensitivity, may be set in the ultraviolet ray irradiating device 9 close to and arranged on the downstream of the recording head 6 in the main scanning direction X. Therefore, the ink of each color can be irradiated with the ultraviolet rays of the wavelength appropriate to the ink in a short time after the arriving of the ink at the recording medium 17. Accordingly, the ink of each color can be further efficiently cured.

Further, in this embodiment, the ultraviolet ray sources 15*a* of the ultraviolet rays having the shorter wavelength component at the emitted light wavelength peak are arranged at both ends of the series of ultraviolet ray sources 15 in the main scanning direction X, and the ultraviolet ray sources 15*b* of the ultraviolet rays having the longer wavelength component at the emitted light wavelength peak are arranged in the middle of the series of ultraviolet ray sources 15 in the main scanning direction X. However, the arrangement of the ultraviolet ray sources 15 is not limited to this. For example, the ultraviolet ray sources 15*a* of the ultraviolet rays having the shorter wavelength component at the emitted light wavelength peak and the ultraviolet ray sources 15*b* of the ultraviolet rays having the longer wavelength component at the emitted light wavelength peak may be alternately arranged.

Moreover, in this embodiment, the cover member 16 is formed in the box shape opened toward the side of the recording medium 17. However, the shape of the cover member 16 is not limited to this. For example, the cover member 16 is formed in an arch shape opened toward the side of the recording medium 17. Therefore, in case of the arch-shaped cover member 16, the width of the cover member 16 in the main scanning direction X can be shortened without reducing the number of ultraviolet ray sources 15, as compared with that in the box-shaped cover member 16. Accordingly, the carriage 4 can be miniaturized, and the entire ink jet printer can be miniaturized.

Further more, the ink to be cured by the irradiation with the ultraviolet rays is used. However, the ink is not limited to this, and the ink to be cured by the irradiation with light other than the ultraviolet rays may be used. "Light" denotes light in the wide sense and includes electromagnetic waves such as an ultraviolet ray, an X-ray, a visible ray, an infrared ray and the like and an electron beam. That is, the polymerizing compound to be cured by the polymerization due to light other than the ultraviolet rays and the photochemical initiator initiating the polymerization reaction of polymerizing compound particles with one another due to the light other than the ultraviolet rays may be included in the ink of this embodiment. When photo-curable ink to be cured by the irradiation with light other than the ultraviolet rays is used, light sources emitting the light must be applied in place of the ultraviolet ray sources 15.

Second Embodiment

Figure 5A:
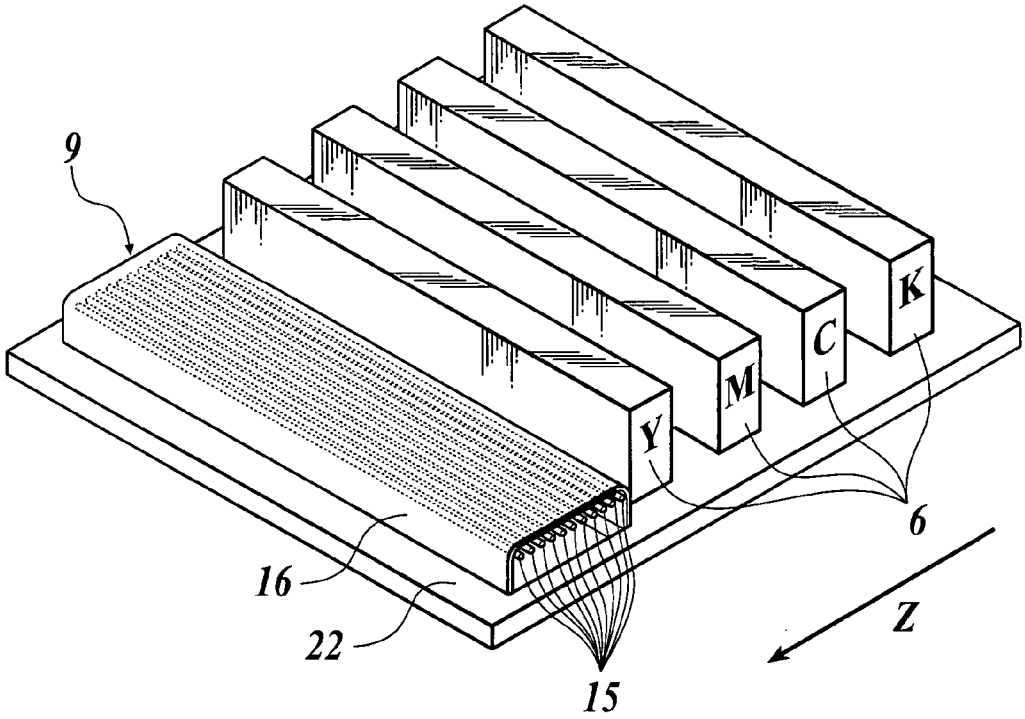
FIG. 5A is a perspective side view showing a supporting member of an ink jet printer according to the second embodiment.
Figure 5B:
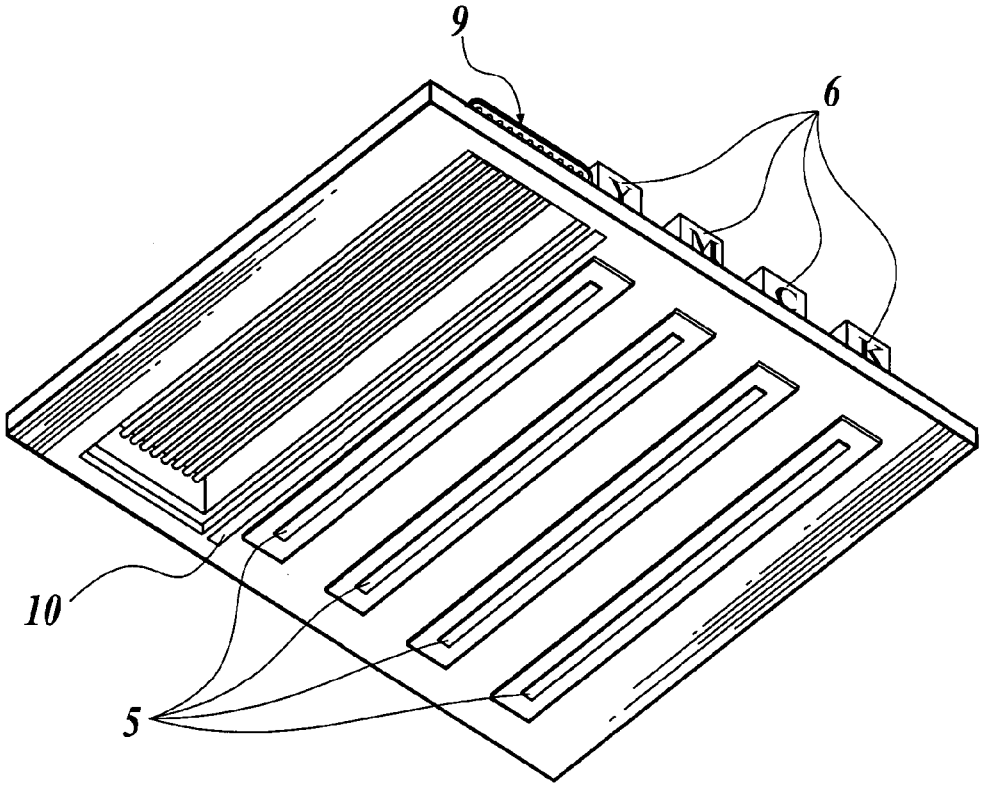
FIG. 5B is a perspective side view showing the supporting member of the ink jet printer seen from the lower side.
Figure 6:
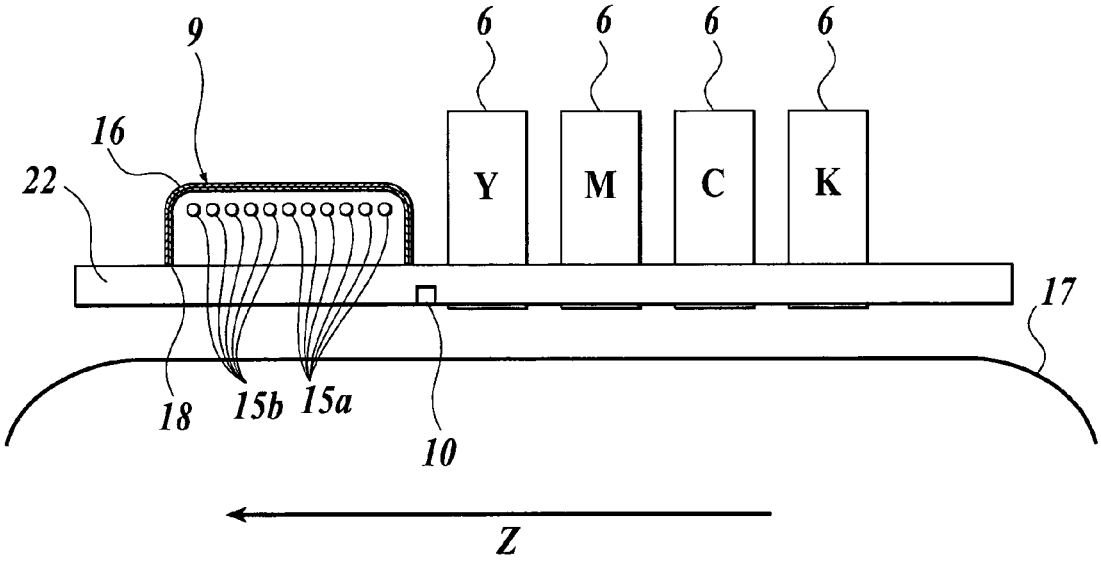
FIG. 6 is a front view of the supporting member of the ink jet printer according to the second embodiment.

Next, an ink jet printer according to the second embodiment of the present invention will be described with reference to FIGS. 5 and 6. The constituent elements indicated by the same reference numerals as those in the first embodiment are the same as those in the first embodiment. Therefore, the description of the constituent elements is omitted.

A plane-shaped supporting member 22 is fixed at a predetermined position of a printer body (not shown), and a platen (not shown) made of a plane-shaped member and supporting an image non-forming surface of the recording medium 17 is arranged below the supporting member 22. A feeding mechanism (not shown) is arranged in the printer body. The feeding mechanism feeds the recording medium 17 onto the platen and feeds out the recording medium 17 from the platen when the image is formed on the recording medium 17.

The four recording heads 6 corresponding to four colors of yellow (Y), magenta (M), cyan (C) and black (K) respectively are arranged on the supporting member 22, and each recording head 6 has a plurality of nozzles 5 for jetting the ink corresponding to the color of yellow (Y), magenta (M), cyan (C) or black (K). Each recording head 6 has the length so as to substantially cover the entire recording medium 17 in the width direction of the recording medium 17 and is arranged in perpendicular to a feeding direction Z of the recording medium 17. The recording heads 6 are of the line head type. The ultraviolet ray irradiating device 9 irradiating the recording medium 17 having the ink jetted from the nozzles 5 with the ultraviolet rays is arranged on the downstream side of the recording heads 6 in the feeding direction Z of the fed recording medium 17. The ultraviolet ray irradiating device 9 comprises the ultraviolet ray sources 15 and the cover member 16 covering the ultraviolet ray sources 15, and the reflecting member 18 is arranged on the entire inside surface of the cover member 16 to reflect the ultraviolet rays.

The ultraviolet ray sources 15*a* of the ultraviolet rays having the shorter wavelength component at the emitted light wavelength peak are arranged in the upstream part of the series of ultraviolet ray sources 15 in the feeding direction Z, and the ultraviolet ray sources 15*b* of the ultraviolet rays having the longer wavelength component at the emitted light wavelength peak are arranged in the downstream part of the series of ultraviolet ray sources 15 in the feeding direction Z.

Next, the operation of the ink jet printer according to this embodiment will be described.

When the recording medium 17 is fed by driving the feeding mechanism, the ink of the predetermined color is jetted from the nozzles 5 of each recording head 6 arranged on the supporting member 22. A plurality of drops of jetted ink arrive at the recording medium 17 one after another. The ultraviolet ray sources 15 composing the ultraviolet ray irradiating device 9 arranged on the supporting member 22 irradiate the pieces of ink arriving at the recording medium 17 with the ultraviolet rays, and the ink is cured on the recording medium 17. During the curing of the ink, the feeding mechanism is operated to feed the recording medium 17, and the image is formed on the recording medium 17.

Next, the curing of the ink caused by the irradiation with the ultraviolet rays will be described. When the recording medium 17 is fed, the ultraviolet ray sources 15*a* corresponding to the shorter wavelength component at the emitted light wavelength peak and the ultraviolet ray sources 15*b* corresponding to the longer wavelength component at the emitted light wavelength peak irradiate the pieces of ink arriving at the recording medium 17 with the ultraviolet rays. At this time, the pieces of ink having high sensitivity to the ultraviolet rays of the shorter wavelength is cured by the ultraviolet rays of the shorter wavelength emitted from the ultraviolet ray sources 15*a* corresponding to the shorter wavelength component at the emitted light wavelength peak, and the pieces of ink having high sensitivity to the ultraviolet rays of the longer wavelength is cured by the ultraviolet rays of the longer wavelength emitted from the ultraviolet ray sources 15*a* corresponding to the longer wavelength component at the emitted light wavelength peak.

Further, the ultraviolet ray sources 15*a* corresponding to the shorter wavelength component at the emitted light wavelength peak are arranged in the upstream part of the series of ultraviolet ray sources 15 in the feeding direction Z, and the ultraviolet ray sources 15*b* corresponding to the longer wavelength component at the emitted light wavelength peak are arranged in the downstream part of the series of ultraviolet ray sources 15 in the feeding direction Z. Therefore, the ink arriving at the recording medium 17 is first irradiated with the ultraviolet rays of the shorter wavelength and is secondly irradiated with the ultraviolet rays of the longer wavelength. When the ultraviolet rays of the shorter wavelength is absorbed or scattered in low degree in the pigment of the ink arriving at the recording medium 17, the ink is cured by the ultraviolet rays of the shorter wavelength with which the ink is first irradiated. On the other hand, when the ultraviolet rays of the shorter wavelength is absorbed or scattered in high degree in the pigment of the ink arriving at the recording medium 17, only the surface of the ink is cured by the ultraviolet rays of the shorter wavelength with which the ink is first irradiated, and the inside of the ink is secondly cured by the ultraviolet rays of the longer wavelength.

As described above, in this embodiment, the ultraviolet ray sources 15*a* and 15*b* emitting the ultraviolet rays of the emitted light wavelength peaks different from each other are arranged in the ultraviolet ray irradiating device 9. Therefore, even though the pieces of ink have high sensitivity to the ultraviolet rays of the plurality of wavelengths, each piece of ink is irradiated with the ultraviolet rays of the wavelength optimum to the curing of the ink. Accordingly, the excellent image can be formed regardless of the type of the ink.

Further, because the ink arriving at the recording medium 17 is first irradiated with the ultraviolet rays of the shorter wavelength and is secondly irradiated with the ultraviolet rays of the longer wavelength. Accordingly, the ink can be efficiently cured by being first irradiated with the ultraviolet rays of the shorter wavelength. Further, even though the ink has high sensitivity to the ultraviolet rays of the longer wavelength, the surface of the ink is cured in a short time after the arriving of the ink at the recording medium 17 by being first irradiated with the ultraviolet rays of the shorter wavelength. Accordingly, the blurring and/or color mixing of the ink on the recording medium 17 can be further prevented, and the excellent image can be formed.

Figure 7:
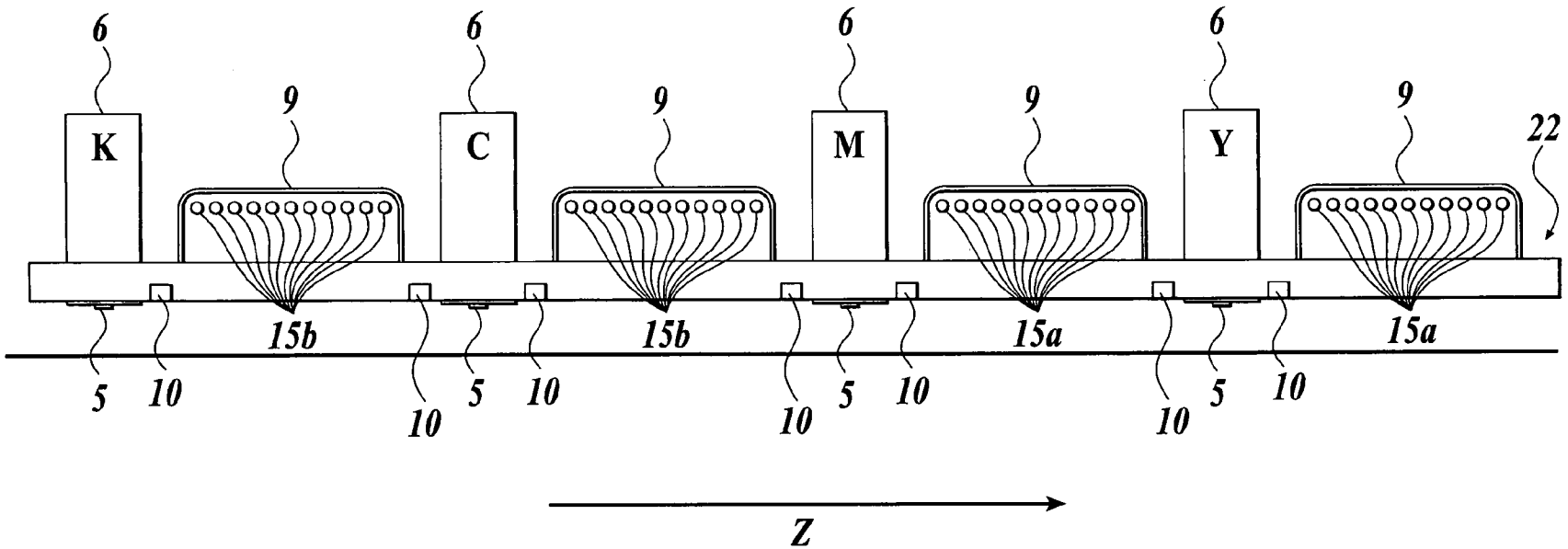
FIG. 7 is a front view of the supporting member of the ink jet printer according to a modification of the second embodiment.

In this embodiment, the ultraviolet ray irradiating device 9 is arranged on the downstream side of the recording unit, which comprises the four recording heads 6 corresponding to the colors of yellow (Y), magenta (M), cyan (C) and black (K), in the feeding direction Z of the recording medium 17. However, as shown in FIG. 7, one ultraviolet ray irradiating device 9 may be arranged on the downstream side of each of the recording heads 6 corresponding to the colors of yellow (Y), magenta (M), cyan (C) and black (K) in the feeding direction Z of the recording medium 17 so as to be place between two recording heads 6.

In this case, a plurality of ultraviolet ray sources 15 emitting the ultraviolet rays of the wavelength, to which the colored ink of one recording head 6 appropriately has high sensitivity, may be arranged in the ultraviolet ray irradiating device 9 placed on the downstream of the recording head 6 in the feeding direction Z for each recording head 6. Therefore, the ink of each color can be irradiated with the ultraviolet rays of the wavelength appropriate to the ink in a short time after the arriving of the ink at the recording medium 17. Accordingly, the ink of each color can be further efficiently cured.

The entire disclosure of Japanese Patent Application No. Tokugan 2002-360933 filed on Dec. 12, 2002 including specification, claims, drawings and summary are incorporated herein by reference in its entirety.

What is claimed is:

1. An ink jet printer comprising:

a recording head, having a nozzle, for jetting ink to be cured by irradiating with an ultraviolet ray from the nozzle, the ink jetted from the nozzle arriving at a recording medium; and an ultraviolet ray irradiating apparatus for irradiating the ink jetted by the recording head with a plurality of ultraviolet rays, an image being formed by irradiating the ink of the recording medium with the ultraviolet rays of the ultraviolet ray irradiating apparatus and curing the ink, wherein:

the ultraviolet ray irradiating apparatus comprises at least one ultraviolet ray irradiating device provided with a plurality of ultraviolet ray sources respectively emitting a plurality of ultraviolet rays of a plurality of light emitting wavelength peaks different from one another; and at least one ultraviolet ray source of the ultraviolet ray having a shorter wavelength component at the light emitting wavelength peak is arranged at a position adjacent to and closer to the recording head than that of the other ultraviolet ray source.

2. The ink jet printer of claim 1; wherein the ultraviolet ray sources emitting the ultraviolet rays of the different light emitting wavelength peaks are arranged in the single ultraviolet ray irradiating device.

3. The ink jet printer of claim 1; wherein the ultraviolet ray irradiating device comprises a plurality of ultraviolet ray irradiating devices, and the ultraviolet ray sources emitting the ultraviolet rays of the different light emitting wavelength peaks are arranged in each of the ultraviolet ray irradiating devices.

4. The ink jet printer of claim 1; wherein the light emitting wavelength peaks of the ultraviolet ray sources range from 220 nm to 400 nm.

5. The ink jet printer of claim 1; wherein each ultraviolet ray source is a hot cathode tube, a cold cathode tube, a light emitting diode or a semiconductor laser.

6. The ink jet printer of claim 1; wherein the ultraviolet ray irradiating device is arranged only on a side of a recording surface of the recording medium.

7. The ink jet printer of claim 1; wherein the ink is a cationic curable ink.

8. The ink jet printer of claim 1; wherein the recording head is of a serial head type, and the ultraviolet ray irradiating device is arranged at least on one of both sides of the recording head in a main scanning direction.

9. The ink jet printer of claim 1; wherein the recording head is of a line head type, and the ultraviolet ray irradiating device is arranged on a downstream side of the recording head in a feeding direction of the recording medium.

* * * * *